US006899157B2

(12) United States Patent
Mullet

(10) Patent No.: US 6,899,157 B2
(45) Date of Patent: May 31, 2005

(54) SECTIONAL DOOR STRENGTHENING MEMBER

(75) Inventor: Willis J. Mullet, Gulf Breeze, FL (US)

(73) Assignee: Wayne-Dalton Corp., Mt. Hope, OH (US)

( * ) Notice: Subject to any disclaimer, the term of this patent is extended or adjusted under 35 U.S.C. 154(b) by 40 days.

(21) Appl. No.: 10/271,219

(22) Filed: Oct. 15, 2002

(65) Prior Publication Data

US 2004/0069421 A1 Apr. 15, 2004

(51) Int. Cl.[7] ..... E05D 15/16
(52) U.S. Cl. ..... 160/235; 16/355
(58) Field of Search ..... 52/588.1, 68, 70, 52/71, 739.1; 160/201, 229.1, 235; 16/355

(56) References Cited

U.S. PATENT DOCUMENTS

| | | | | | |
|---|---|---|---|---|---|
| 2,886,102 | A | * | 5/1959 | Olsen et al. | 160/235 |
| 3,511,301 | A | * | 5/1970 | Graham et al. | 160/209 |
| 4,779,325 | A | | 10/1988 | Mullet | 29/460 |
| 4,924,932 | A | * | 5/1990 | Esnault | 160/201 |
| 4,934,439 | A | | 6/1990 | Martin | 160/201 |
| 5,383,509 | A | | 1/1995 | Gaffney et al. | 160/209 |
| 5,445,208 | A | | 8/1995 | Shaner et al. | 160/232 |
| 5,706,877 | A | * | 1/1998 | Grisham et al. | 160/201 |
| 5,709,259 | A | | 1/1998 | Lewis et al. | 160/201 |
| 5,749,407 | A | | 5/1998 | Brenner et al. | 160/229.1 |
| 5,857,510 | A | | 1/1999 | Krupke et al. | 160/201 |
| 5,896,724 | A | | 4/1999 | Tofts | 52/739.1 |
| 6,112,799 | A | | 9/2000 | Mullet et al. | 160/201 |
| 6,129,132 | A | * | 10/2000 | Denoual et al. | 160/235 |
| 6,161,606 | A | | 12/2000 | Wegner et al. | 160/229.1 |
| 6,250,361 | B1 | | 6/2001 | Ochoa | 160/201 |
| 6,330,901 | B1 | * | 12/2001 | Friesen et al. | 160/201 |

FOREIGN PATENT DOCUMENTS

| | | | |
|---|---|---|---|
| DE | 26 45 671 A1 | 4/1978 | |
| EP | 0 702 124 A1 | 3/1996 | E06B/3/48 |
| FR | 2 748 770 | 11/1997 | E05D/1/04 |

* cited by examiner

*Primary Examiner*—Blair M. Johnson
(74) *Attorney, Agent, or Firm*—Renner, Kenner, Greive, Bobak, Taylor & Weber

(57) ABSTRACT

A sectional door D having a plurality of panels (35), a first hinge leaf (44) formed on one edge of a panel and a second hinge leaf (42) formed on a second edge of the panel, wherein first and second hinge leaves on adjacent panels interrelate to form a hinge pivotally joining the panels, and a strengthening member (50) having a body portion (51) adapted to capture the hinge leaves and attachable to the panels near at least one of the first hinge leaf and the second hinge leaf.

31 Claims, 7 Drawing Sheets

SECTIONAL DOOR STRENGTHENING MEMBER

TECHNICAL FIELD

In general, the present invention relates to a multi-panel sectional door. More particularly, the present invention relates to a system for strengthening a multi-panel sectional door. More specifically, the present invention relates to a multi-panel sectional door having a strut or strengthening member integrated into the hinge area of the door.

BACKGROUND ART

In existing multi-panel sectional doors, struts or stiffening beams are added to provide strength to the door. The struts or stiffening beams are normally separate members that are fastened to the door after its installation. The struts may be as simple as wooden boards, such as, two-by-fours or more complex metallic members that have been shaped to maximize reinforcement, systems that tension the door to provide strength, or integral struts formed as part of a polymeric panel.

For example, one design available in the industry incorporates a stiffener having a horizontal body, an inner vertical mounting flange and an outer bowed flange, where the vertical mounting flange and bowed flanges have free edges and respective beads or curls formed thereon to stiffen the flanges providing strength to the door. In another design, a reinforcing strut has multiple arcuate sections that strengthen the strut and provide for its attachment to the door. Still another design incorporates unique track assemblies that work in conjunction with rollers and restraining members to place each section in tension.

As mentioned, many of these designs incorporate flanges or other members, such as feet, that allow for attachment of the strut to the door by fasteners. While these members enjoy the advantage of determining the amount of strengthening at the time of installation, they require additional time to install. Also, the necessary mechanical fasteners, such as, screws and clips add to the cost of the door. As a further disadvantage, while the struts provide a great amount of stiffness, they typically do not distribute the stiffness uniformly unless several struts are used and spaced uniformly across the door. To achieve this type of uniformity with existing designs, for example, by attaching multiple uniformly spaced struts to the door, the amount of reinforcement may become unnecessarily high for the strengthening requirements of the door. As will be appreciated, this adds unnecessary cost and weight to the door.

In still another design in the industry, the panel sections, themselves, are formed with areas of increased thickness at their ends to strengthen, in effect, by integrally forming a strut in the panel. In contrast to those designs where the strut is separately attached, the integrally formed strut may not be adjusted in terms of size or location in response to the individual strength requirements of the door after the door has been manufactured. This design, also, increases the amount of packaging for the door and space needed for storage and shipment.

SUMMARY OF THE INVENTION

It is, therefore, an object of the present invention to provide an improved strengthening member for a sectional door. Another object of the present invention is to provide a strengthening member that is integral with the hinge of a sectional door. It is a further object of the present invention to provide a strengthening member that becomes integral with the door when the hinges are assembled and interconnected on the door. Still another object of the present invention is to provide a door system with a strengthening member that may be designed to achieve the desired strength of the door by varying the length of the member extending rearwardly of the door.

A further object of the present invention is to provide a strengthening member for a sectional door which assists in maintaining the integrity of the hinge configuration. Another object of the invention is to provide such a strengthening member which contributes to a pinch-resistant design during articulation of the door. Still another object of the invention is to provide struts or strengthening members which may be substantially uniformly vertically spaced by positioning at the junctures between the panels.

Another object of the present invention is to provide a strengthening member for a sectional door which does not require mechanical fasteners, clips, or other additional components to effect installation on a door, thereby avoiding additional costs of material. A still further object of the invention is to provide a strengthening member which can be readily installed such as to add no appreciable labor expense to the assembly of the door. Yet another object of the invention is to provide such a strengthening member which is itself relatively inexpensive in requiring a minimum of material and ease of fabrication.

In general, the present invention contemplates a sectional door having a plurality of panels, a first hinge leaf formed on one edge of a panel and a second hinge leaf formed on a second edge of the panel, wherein first and second hinge leaves on adjacent panels interrelate to form a hinge pivotally joining the panels, and a strengthening member having a body portion adapted to capture the hinge leaves and attachable to the panels near at least one of the first hinge leaf and the second hinge leaf.

DETAILED DESCRIPTION OF THE INVENTION

Figure 1:
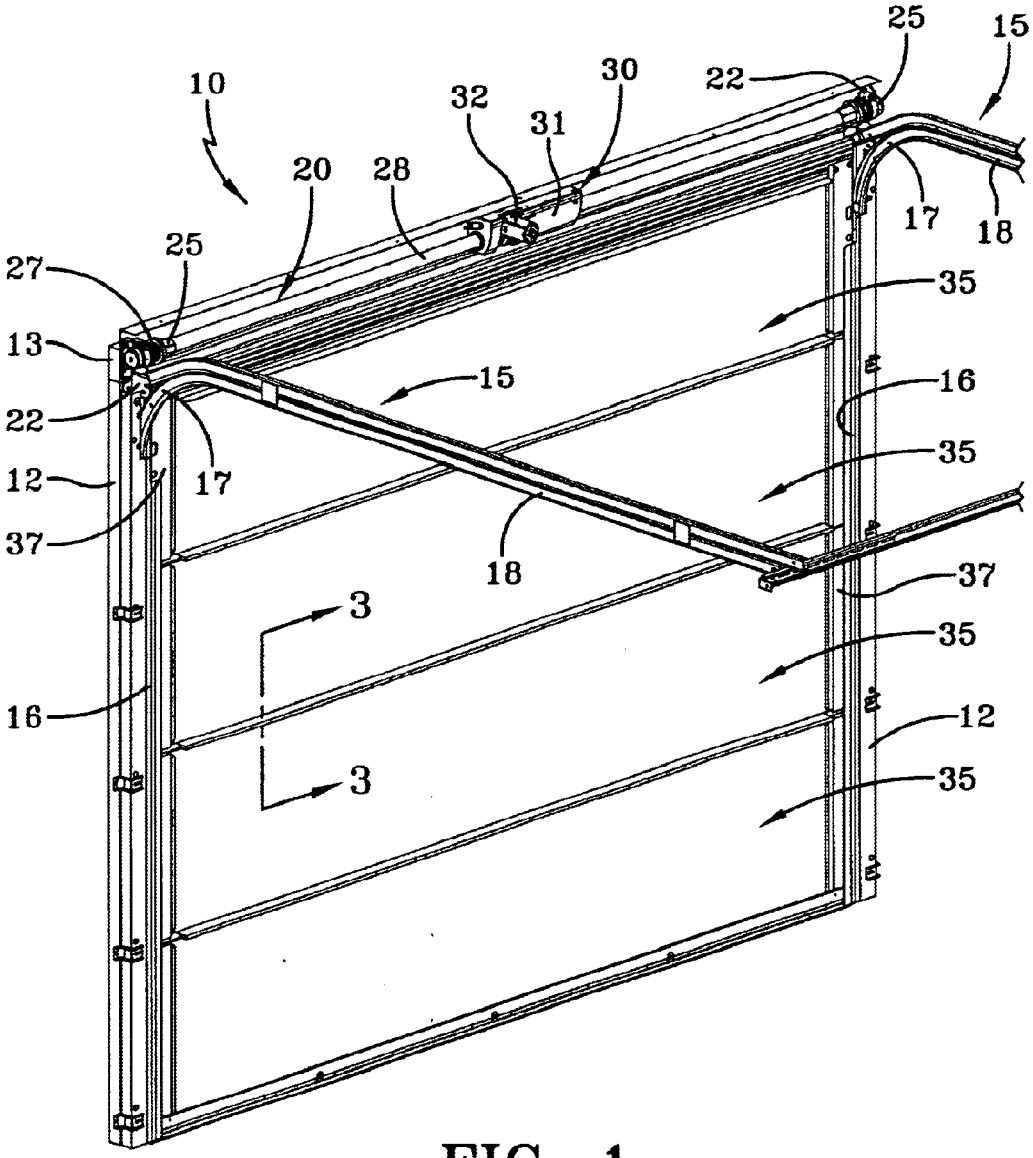
FIG. 1 is a rear perspective view of a sectional door assembly located between spaced vertical jambs joined by a header to form a U-shaped frame, where the sectional door is shown in a generally vertical closed position and is movable along generally L-shaped tracks that guide the door from a closed vertical position to an open horizontal position, where the door is depicted with a plurality of strengthening members according to the concepts of the present invention and located at the juncture of adjacent door sections.
Figure 2:
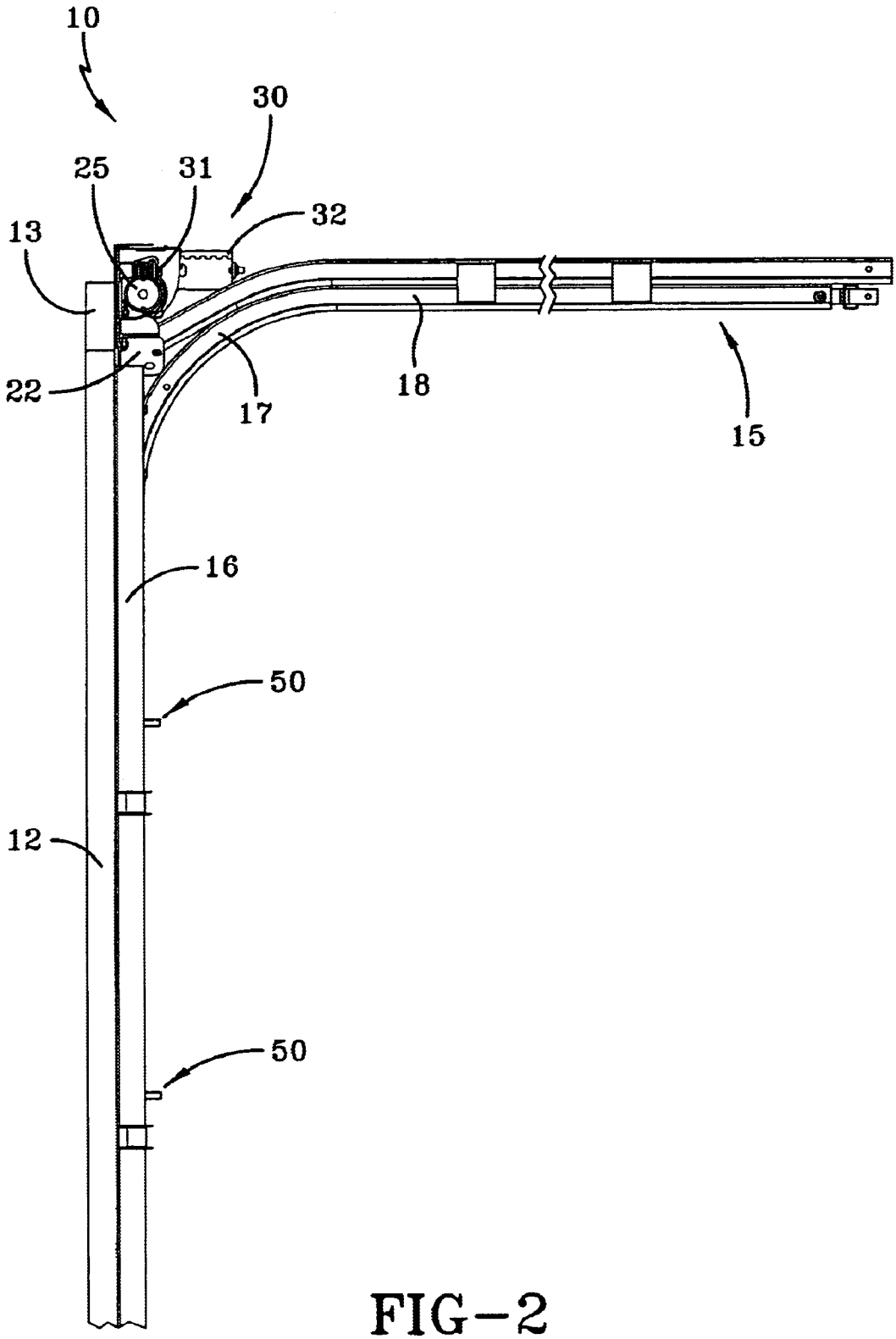
FIG. 2 is a fragmentary side elevational view of the door assembly of FIG. 1 depicting a plurality of the strengthening members extending rearwardly of the sectional door and tracks therefor.
Figure 3:
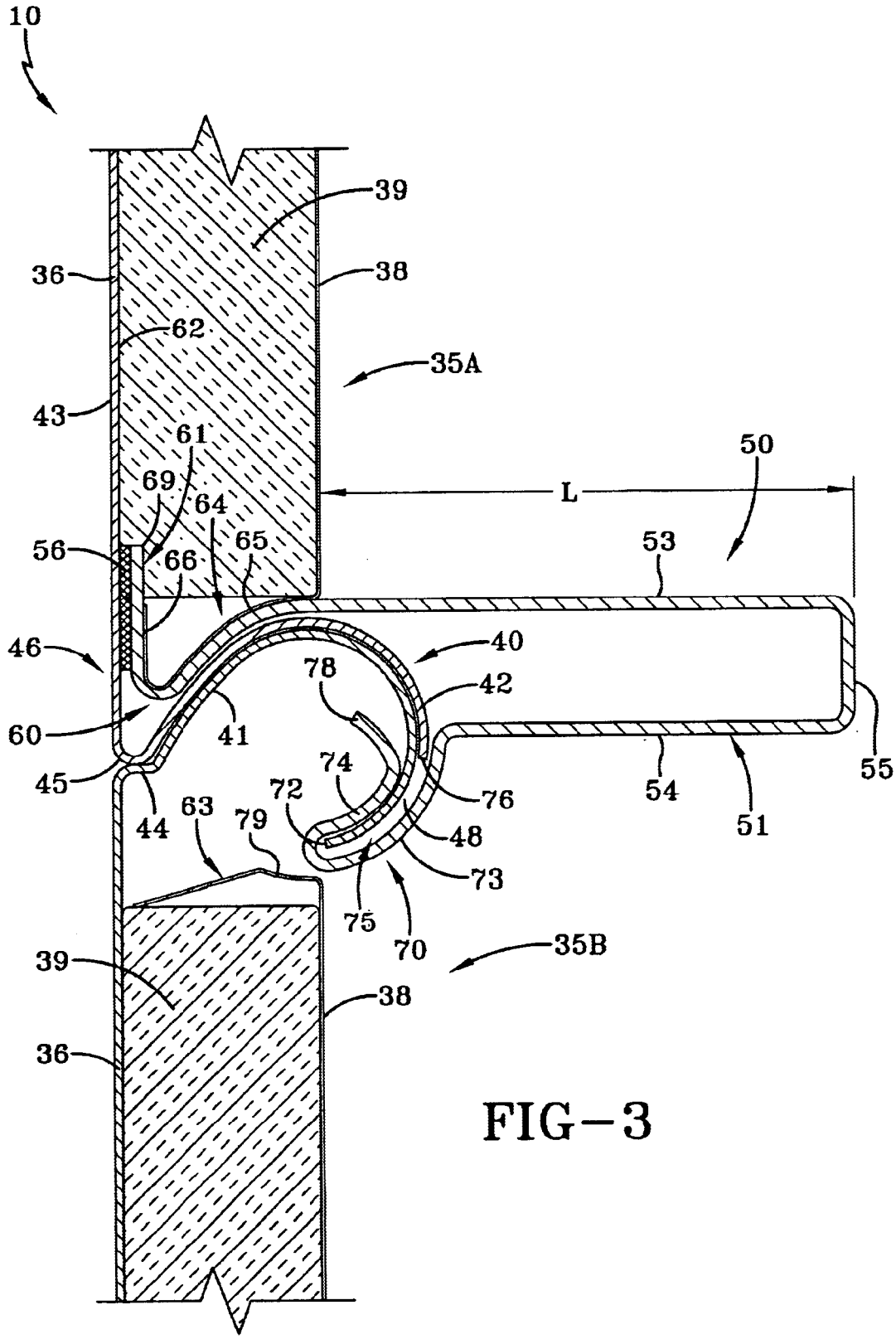
FIG. 3 is a fragmentary sectional side elevational view, taken substantially along lines 3—3 in FIG. 1, depicting details of a strengthening member shown integrally mounted at the hinge between adjacent sections of the door.

A door system according to the concepts of the present invention is generally indicated by the numeral 10 in FIGS. 1–3 of the accompanying drawings. Referring particularly to FIGS. 1 and 2, the door system 10 is located within vertically extending jambs 12, 12 spaced and joined by a horizontal header 13 to form an inverted U-shaped framework, generally indicated by the numeral 14. Track assemblies, generally indicated respectively by the numeral 15, may be supported by the jambs 12, 12 and include generally upright vertical track sections 16, 16 located adjacent the framework 14, arcuate transition track sections 17, 17 extending upward and rearward of the vertical track section 16, 16, and generally horizontal upper track sections 18, 18 extending rearward of the transition track sections 17, 17. In a manner well known in the art, track sections 16, 17, 18 guide the door D between a generally closed vertical position, shown in FIG. 1, and a generally open horizontal position (not shown).

To offset the weight of the door D and to facilitate its movement between the closed and open positions, a counterbalance system, generally indicated by the numeral 20, may be provided. Since a number of counterbalance systems are available in the art, which would be suitable for use with the concepts of the present application, the counterbalance system 20 will only be referred to in general terms. The counterbalance system 20, as illustrated in FIG. 1, for exemplary purposes only, is in accordance with the teachings of applicant's assignee's U.S. Pat. No. 5,419,010, which is incorporated herein by reference. Counterbalance system 20 includes a pair of brackets 22, 22 located at either end of the header 13 above jambs 12, 12 mounting a pair of cable drums 25, 25 rotatably received on the brackets 22, 22 and operatively interrelated with a counterbalance spring (not shown). The counterbalance spring acts to rotationally bias the drums against the weight of the door D such that a biasing force is transmitted through the drums via a cable 27 attached to and coiled about the drums 25, 25 at one end and to the door D at the other end. In accordance with the teachings of U.S. Pat. No. 5,419,010, cable drums 25, 25 may be supported on a drive tube 28 and the counterbalancing spring positioned interiorly of the drive tube 28. Further, drive tube 28 may have a non-circular cross-section corresponding to similarly sectioned non-circular receivers formed within the cable drums 25, 25 such that the cable drums 25, 25 rotate with the drive tube 28. It will be appreciated that other arrangements may be used to cause the cable drums 25, 25 to rotate with a shaft or drive tube 28.

While the door D may be manually operated, a motorized operator generally indicated by the numeral 30 may be incorporated, as shown for example in FIG. 1. It will be appreciated that any operator 30 available in the industry may be used in connection with the door D including the pivoting operator 30 shown. The operator 30 receives a portion of the drive tube 28 within its housing 31 for direct interrelation between the drive tube 28 and the motor 32. Motor 32 is reversible and drive tube 28 and accordingly cable drums 25, 25 may be rotated in both clockwise and counterclockwise directions to selectively coil and uncoil the cable 27 thereabout. As mentioned, however, any number of commercially available operator systems including those which operate by attachment to the door D may be used in the context of the present invention.

As mentioned, door D has a plurality of sections or panels, generally indicated by the numeral 35. When referring to adjacent sections, a numeral and letter combination will be used to reference individual sections at a joint irrespective of their location vertically of the door D. Thus, a superjacent section 35 will be generally indicated as 35A and a subjacent section will be generally indicated as 35B (see FIG. 3). As best seen in FIG. 3, panels 35 may be of sheet-like construction and include a primary structural member or facer 36, end stiles 37, 37 (FIG. 1), and optionally a backer member 38, which may be used to hold insulating material 39 within the panels 35. As will be appreciated, panels 35 may be a one piece hollow or solid formed member. Panels 35A and 35B are pivotally joined at their juncture by a hinge assembly, generally indicated by the numeral 40, preferably formed as extensions of respective facers 36. As best shown in FIG. 3, hinge assembly 40 may include an interleaved structure including a first hinge leaf 41 extending from the uppermost edge of subjacent section 35B and a second hinge leaf 42 that extends from the lowermost edge of superjacent section 35A, such that, the first and second hinge leaves 41, 42 of adjacent sections 35A, 35B operatively interrelate to provide pivotal motion of the joined sections 35 relative to each other, as will be described more completely below.

The first hinge leaf 41 may be offset from the front face 43 of the section 35B by a generally horizontally extending land 44 providing a clearance for a downwardly protruding nose 45 formed on the lowermost end 46 of an adjacent section 35A. From the land 44, first hinge leaf 41 transcends a generally U-shaped arch, which as shown may extend initially rearwardly and upwardly toward the base of the U which may lie at a negatively sloped angle relative to the horizontal and then the second leg of the U may transcend downwardly and inwardly toward the front of the door D giving the arch a generally upwardly angled, inverted disposition relative to the vertical plane of the closed door D. The second hinge leaf 42 cooperatively engages the first leaf 41 and may extend initially upwardly and rearwardly from the nose 45 transcending an arch similar to that of first leaf 41. As shown, the second leaf 42 is shorter than first leaf 41 to provide a clearance 48 for the movement of the second leaf 42 during articulation of the adjacent panels 35A, 35B, and overlapping support of first leaf 41 and second leaf 42 during the full extent of relative pivotal motion.

A strengthening member, generally indicated by the numeral 50, may be attached at each hinge assembly 40 to reinforce the door D. Locating a strengthening member 50 at each of the hinges 40 provides a convenient means of uniformly spacing the strengthening members 50 relative to the door D, particularly where the width is uniform for all of the sections 35. The strengthening member 50 may be constructed of materials commonly used in the art including plastics and metals, for example, aluminum or steel. It will be appreciated that the type of material may be selected based on the strengthening needs and materials of a particular door application. The strengthening member 50 includes a body portion, generally indicated by the numeral 51, which may be of somewhat rectangular profile, as shown, and extend a length L measured relative to the backer member 38 of superjacent sections 35A depending upon the degree of reinforcement necessary for a particular door application. As necessary, strengthening member 50 may extend laterally substantially the entire width of a section 35 between end stiles 37, 37 and preferably at least approximately 90% of the width of sections 35. Body portion 51, may be hollow, as shown, having a first leg 53 and a second leg 54 spaced from each other by a third leg 55 spacing and joining the first and second legs 53, 54. Body portion 51 may have a rectangular profile such that the first leg 53 and second leg 54 extend perpendicular to the third leg 55 and parallel to each other. First and second legs 53, 54 are advantageously oriented generally perpendicular to the plane of the door D, when the door D is in the closed vertical position, as shown in FIG. 3.

Strengthening member 50 may be attached to the door D by a fastener 56 including mechanical fasteners, such as, screws or clips, or a non-mechanical fastener, such as a weld or an adhesive. To facilitate attachment of the strengthening member 50, first leg 53 may be provided with an extension, generally indicated by the numeral 60, having an attachment portion 61 oriented parallel to the interior surface 62 of the facers 36 to provide effective attachment of strengthening member 50. When using an adhesive as the fastener 56 it is spread between the surface 62 and the attachment portion 61 to effect joinder therebetween, as shown. It will be appreciated that the strengthening member 50 may be attached at other locations on the panel including backer member 38 thereof in some instances. In the embodiment shown, attachment is made to the interior surface 62 of facers 36 and, thus, extension 60 must extend inward of the backer member 38 of section 35A.

While accommodation for the placement of the extension 60 interiorly of the backer member 38 may be made within the panel 35A, such as providing an opening within the backer member 38, extensions 60 may be conformed to the clearance provided adjacent the hinge 40, as shown in FIG. 3. Backer member 38 of panel 35 extends substantially parallel to facer 36 proximate to the hinge leaves 41, 42, and, at either edge, turns inwardly toward facer 36 to substantially close each panel 35. To that end, first and second clip members 63, 64 extend inwardly from the backer member 38 respectively adjacent the first and second hinge leaves 41, 42, respectively.

Second clip member 64 has a first section 65 that extends inwardly and downwardly from the backer member 38 in an arcuate fashion that conforms generally to the shape of the second leaf 42 and a second section 66 that is turned upwardly and extends generally parallel to the interior surface 62 of facer 36. In the embodiment shown, the second clip member 64 is resilient and, thus, may be deformed to permit entrance of the extension 60 while maintaining a close fit with the clip member 64 once in place. Alternatively, second clip members 64 may be spaced from the second hinge leaf 42 to provide suitable space for receipt of the extension 60. To provide for the operation of the hinge 40, extension 60 may provide a minimal clearance, as shown, to allow free movement of the second leaf 42, or lubrication may be applied between the surfaces of the second hinge leaf 42 and extension 60 or self lubricating materials may be used. In the illustrated example, the extension 60 of first leg 53 extends inwardly, toward the front of the door D, and downwardly in an arcuate fashion corresponding to that of the second hinge leaf 42 to allow the extension 60 to extend inwardly of the backer member 38 of the section 35 to a point proximate the nose 45. From this point, attachment portion 61 of extension 60 extends upwardly adjacent the interior surface 62 of facer 36.

A second extension, generally indicated by the numeral 70, may be provided on the second leg 54 to attach the strengthening member 50 to the subjacent section 35B, as by a clip-like attachment to the first hinge leaf 41, as shown. In the illustrated example, an elongated U-shaped extension 70 extends initially downward and inwardly from the second leg 54 substantially conforming to the arc of the first leaf 41, turning back upon itself near the end 72 of first leaf 41 and extending upwardly and rearwardly in an arcuate manner again substantially conforming to the arc of the first leaf 41. The sides 73, 74 of the extension 70 are spaced to suitably receive the first and second leaves 41, 42 therein. As seen in FIG. 3, when the door D is in the generally closed vertical position, a clearance 75 is defined between the extension 70 and the end 76 of the second leaf 42 suitable for permitting advancement of the second leaf 42 during the pivoting motion of the adjacent sections 35. Extension 70 may include an inwardly turned end 78 that may extend generally perpendicularly to the side 74 of extension 70. During installation, inwardly turned end 78 may facilitate attachment of the strengthening member 50 by guiding the first and second hinge leaves into the clearance 75 between sides 73, 74 of extension 70.

The first clip member 63 in extending inwardly from the backer member 38 is configured to avoid engagement with extension 70 during articulation of strengthening member 70. To that end a concave dished segment 79 may be provided to permit passage of side 73 of second-extension 70.

By attaching the strengthening member 50 at the hinge 40, the strengthening member 50 becomes integral with the door D upon assembly. Since the strengthening member 50 may be attached by its configuration or an adhesive, mechanical fasteners, such as screws, are not necessary, thus, reducing the time necessary to assemble the door D and the door's ultimate cost.

While the present invention may be used in connection with a pan door, as illustrated, other sectional doors may be suitable. Further, when a hollow door such as the pan door shown is used, insulating material 39 may be inserted within the panels 35 without interfering with the attachment of the strengthening member 50.

Figure 4:
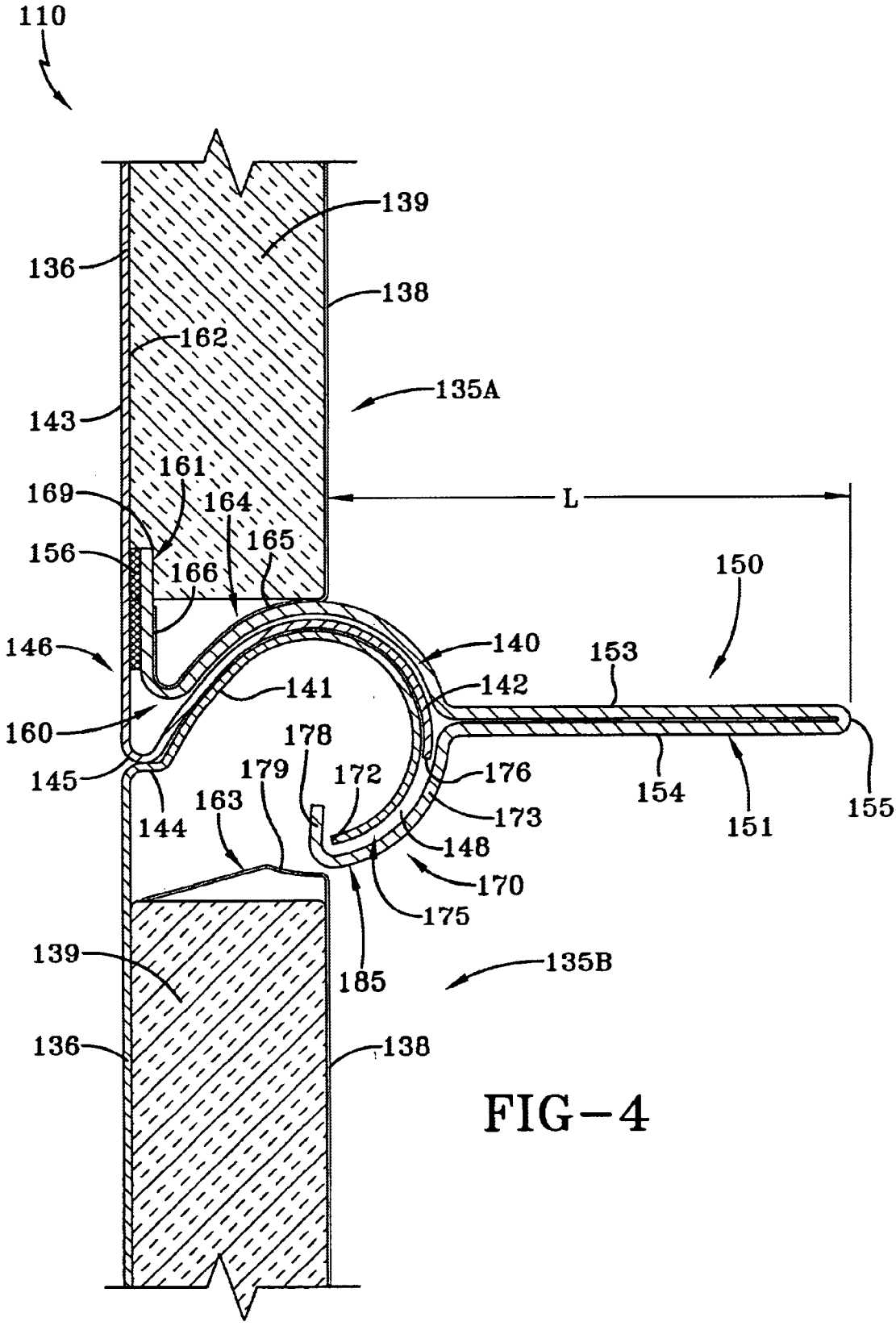
FIG. 4 is a fragmentary sectional side elevational view, similar to FIG. 3, depicting details of a first alternative strengthening member shown integrally mounted at the hinge between adjacent sections of the door.

As mentioned previously, the form of strengthening member 50, is somewhat dictated by the shape of the hinge leaves 41, 42 and thus, variation to the form of the strengthening member 50 may be made without deviating from the concepts of the present invention. For example, a first alternative strengthening member, generally indicated by the numeral 150, is shown in FIG. 4. Strengthening member 150 is similar to strengthening member 50 and like numbers will be used in connection with like components common to each embodiment. Strengthening member 150 includes a rearwardly extending body portion, generally indicated by the numeral 151, which may include a first leg 153 and second leg 154 joined by a third leg 155. With reference to FIG. 4, first leg 153 and second leg 154 lie in close proximity to one another and extend rearwardly relative to the door D in a generally horizontal fashion with legs 153, 154 being generally parallel to each other. Due to their close proximity, third leg 155 is short and, as shown, may take the form of an arcuate transition connecting the rearward ends of first and second legs 153, 154. As in the previous embodiment, the body portion 151 extends a length L relative to the backer member 138 of the door D. Adjustments may be made to the length L depending on the loading conditions of a particular door D. In the vertical direction, the body portion 151 is located at substantially the same height as the nose 145 of the superjacent panel 135A or otherwise substantially perpendicular to a plane extending through the juncture between the panels 135A, 135B when door D is in the closed vertical position of FIG. 4. To accommodate this position, a first extension, generally indicated by the numeral 160, extends initially upward from the first leg 153 in a manner closely conforming to the hinge leaf 142 located adjacent thereto. As shown, extension 160 may transcend a generally semicircular arc in conformity with the radius of second hinge leaf 142. As in the previous embodiment, an attachment portion 161 may extend upwardly adjacent the interior surface 162 of facer 136 to facilitate attachment of the extension 160 to the door D. As before, to provide attachment, an adhesive 156 may be used to secure the attachment portion 161 to the interior surface 162 of facer 136. Otherwise, as before, the extension 160 may cooperate with a second clip member 164 residing between the first section 165 of clip member 164 and the second hinge leaf 142 and near the facer 136, between the second section 166 of clip member 164 and the facer 136 of door D to resiliently hold the strengthening member 150 in place.

A second extension, generally indicated by the numeral 170 extends from second leg 154 downwardly and inwardly toward the front of the door D a length corresponding to the extent of the first leaf 141. In contrast to the previous embodiment, a first side 173 extends downwardly and inwardly beyond the end 172 of first hinge leaf 141 omitting the side 74 of FIG. 3 used to form a U-shaped structure in the previous embodiment 50. A flange 178 extends upwardly from the end of side 173 to capture the end 172 of hinge leaf 141 and define a clearance at 175 for advancement of the end 176 of second hinge leaf 142, as described above in conjunction with FIG. 3.

Figure 5:
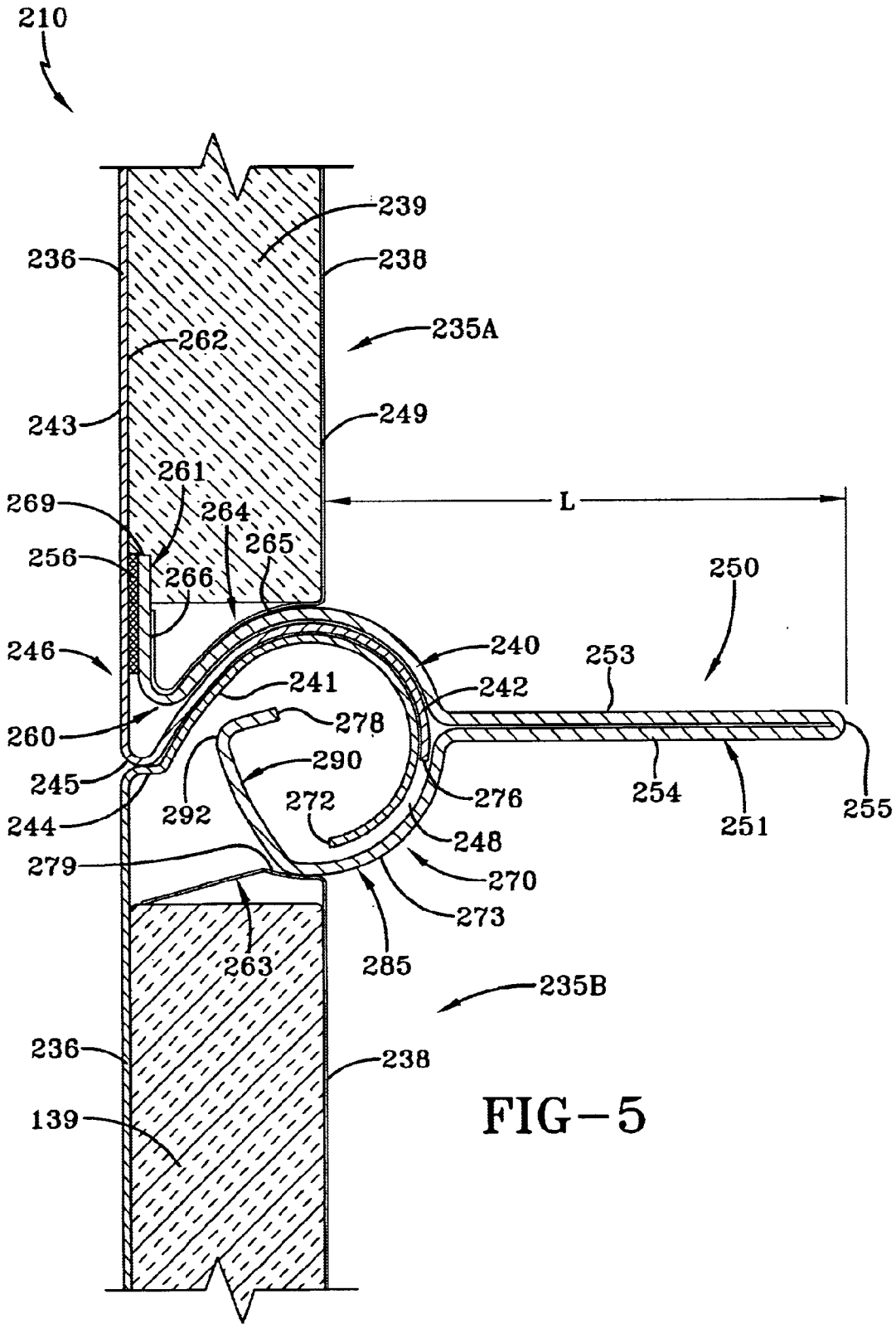
FIG. 5 is a fragmentary sectional side elevational view, similar to FIG. 3, depicting details of a second alternative strengthening member shown integrally mounted at the hinge between adjacent sections of the door.

A second alternative strengthening member, generally indicated by the numeral 250, is shown in FIG. 5. The strengthening member 250 is similar to the previously described strengthening members and like numerals will be used to refer to like parts within the description to follow. Structurally, strengthening member 250 is similar to strengthening member 150 with the exception that it provides a pinch resisting extension, generally indicated by the numeral 290, to close the gap 185, shown in FIG. 4. It will be appreciated that this gap closing feature may be incorporated in other designs to perform a similar pinch resisting function.

Strengthening member 250 includes a body portion 251 extending a length L rearward of the backer member 238, which may be adjusted according to the particular loading conditions of the door D. As in previous embodiments, a body portion 251 of strengthening member 250 may include first and second legs 253, 254, may be oriented generally parallel to each other and may extend generally rearward of the door D. As in strengthening member 150, first and second legs 253, 254 are shown in close proximity with a short transitional third leg 255 connecting the rearward extremities. Also similar to strengthening member 150, a first extension, generally indicated by the numeral 260 extends from first leg 253 to attach the strengthening member 250 to the door D. A second extension, generally indicated by the numeral 270, extends downward and inward from the second leg 254 adjacent to and in conformity with the first and second hinge leaves 241, 242. Near its lower extremity, generally indicated by the numeral 285, side 273 of second extension 270 contacts first clip member 263 of the backer member 238. As shown, first clip member 263 may be provided with a concave dished segment 279 which may generally correspond with the radius of extension 273 to permit sliding passage of the extension 273 over first clip member 263 during articulation of the door D.

The pinch resisting extension 290 extends upwardly and inwardly from the lower extremity 285 of side 273 in a generally linear fashion. Flange 278 may extend rearwardly from extension 290 with an arcuate transition 292 formed therebetween. As shown, the flange 278 may extend generally perpendicular relative to the extension 290 to provide a rigidifying effect.

Figure 6:
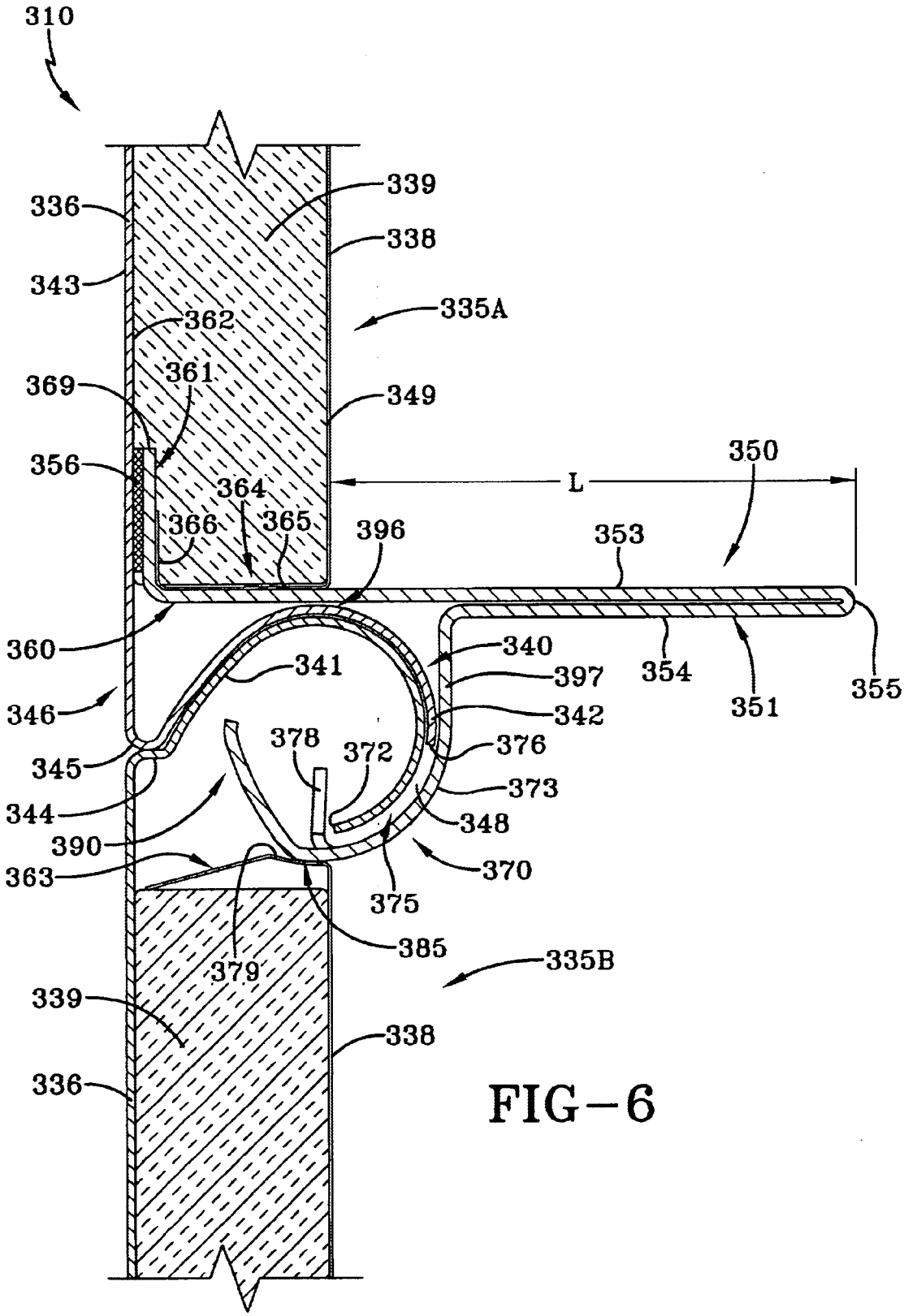
FIG. 6 is a fragmentary sectional side elevational view, similar to FIG. 3, depicting details of a third alternative strengthening member shown integrally mounted at the hinge between adjacent sections of the door.

A third alternative embodiment of a strengthening member, generally indicated by the numeral 350, is depicted in FIG. 6. As in previous embodiments, like numerals will be used to refer to similar structures. Strengthening member 350 includes a body portion, generally indicated by the numeral 351, which may have a first leg 353 and a second leg 354 extending rearwardly relative to the door D. Legs 353 and 354 may be located in close proximity to one another and in substantially parallel relation to each other, as shown, with a third leg 355 forming an arcuate transition therebetween. As in previous embodiments, the body portion 351 may be formed such that when the door D is in the vertically closed position, the body portion 351 extends in a generally horizontal plane or perpendicular to the door D. The body portion 351 may be vertically located substantially at the upper extremity, generally indicated by the numeral 396, of hinge 340. In this embodiment, the first leg 353 extends in a generally horizontal fashion just above hinge 340 having a first extension 360, which is insertably received between the second hinge leaf 342 and backer member 338. First extension 360 may include an upturned attachment portion, generally indicated by the numeral 361, to facilitate attachment to the door D, as by an adhesive 356, as previously described. Alternatively, as described in more detail above, the interference fit created between the second clip member 364 of backer member 338 and second hinge leaf 342 with the first leg 353 is suitable to hold the strengthening member 350 in place.

A second extension, generally indicated by the numeral 370, extends from the second leg 354 to encompass the ends 372, 376 of first and second hinge leaves 341, 342. Second extension 370 has a first portion 397 that extends downwardly in a generally linear fashion to a point generally rearwardly of the juncture between the land 344 and nose 345 of adjacent panels 335A, 335B. In the embodiment shown, this point coincides with the vertical position of the end 376 of second hinge leaf 342, when the door D is in the generally closed vertical position depicted in FIG. 6. From this point, side 373 extends in an arcuate fashion of similar radius to that of the hinge leaves 341, 342 being radially spaced therefrom to define a clearance at 375 that allows advancement of the second hinge leaf 342, during articulation of the door D. A flange 378 extends upwardly from side 373 adjacent the end 372 of first hinge leaf 341 to trap the first and second hinge leaves 341, 342, as described in previous embodiments.

A pinch resisting extension, generally indicated by the numeral 390, similar to extension 290 in the previous embodiment, is incorporated on second extension 370 to prevent the opening of gaps between strengthening member 350 and the subjacent panel 335B which could entrap objects within the garage including clothing or fingers. Thus, at its lowermost extremity, generally indicated by the numeral 385, second extension 370 contacts first clip member 363 of panel 335B. As in the previous embodiment, clip member 363 may be provided with a concave dished segment 379 to facilitate movement of the strengthening member 350.

Extension 390 extends upwardly and inwardly, as described in a previous embodiment, to a vertical height generally corresponding to a point above the juncture between the nose 345 and land 344 of adjacent sections 335A, 335B. As before, this extension 390 may extend in a generally linear fashion.

Figure 7:
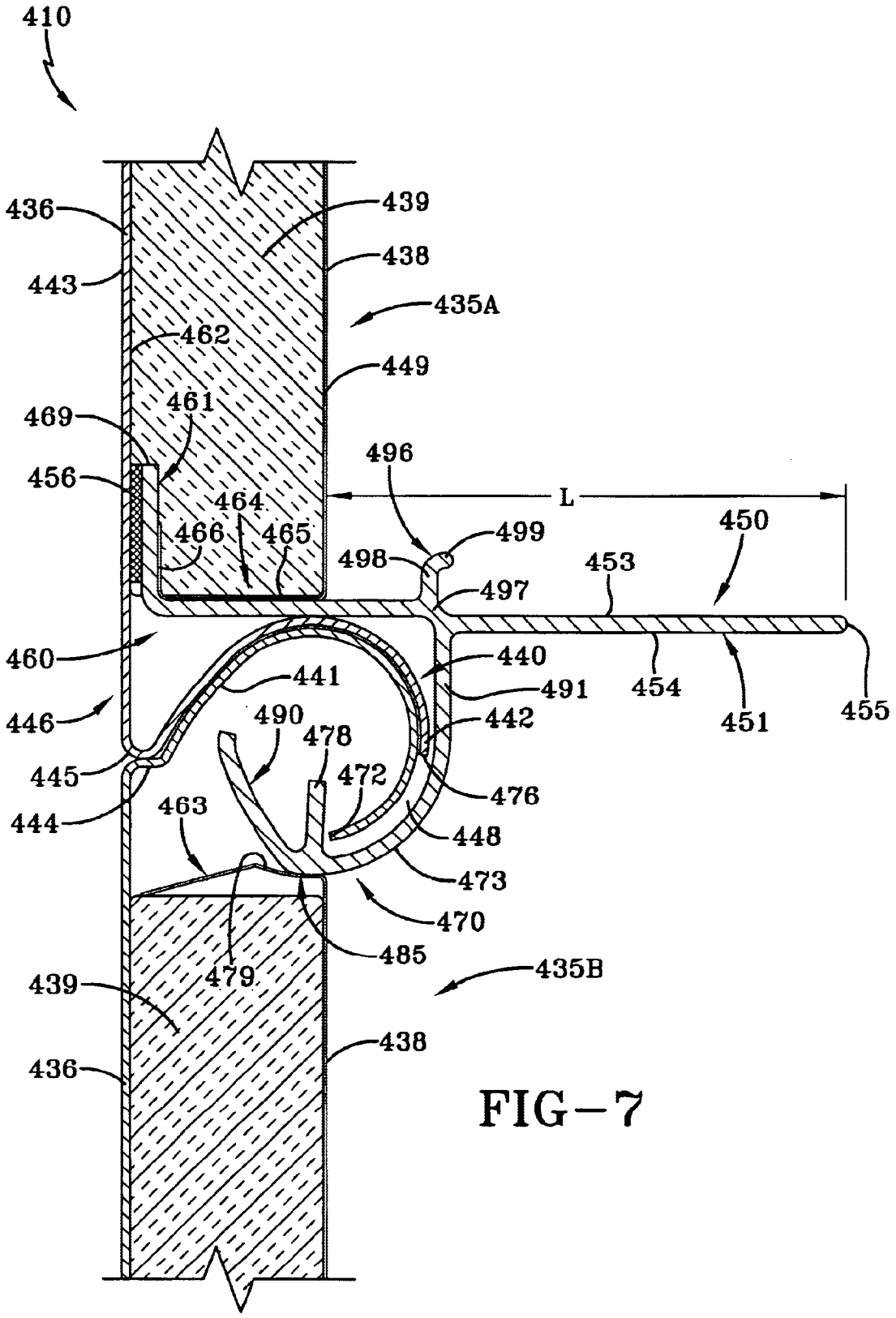
FIG. 7 is a fragmentary sectional side elevational view, similar to FIG. 3, depicting details of a fourth alternative strengthening member shown integrally mounted at the hinge between adjacent sections of the door.

A fourth alternative embodiment of a strengthening member, generally indicated by the numeral 450, is depicted in FIG. 7. Strengthening member 450 is similar to strengthening member 350 and, thus, like numbers are used to describe like structures in this embodiment. Strengthening member 450 illustrates that the strengthening member need not have parallel legs. In contrast to the roll formed two-legged structure depicted in FIG. 6, strengthening member 450 may be formed by an extrusion process. Strengthening member 450 has a body portion 451 located substantially in the position of the second leg 354 in FIG. 6 and, thus, first extension 460 of strengthening member 450 extends initially upward to a small extent to clear second hinge leaf 442. From this point, extension 460 extends in a generally horizontal manner inward toward the front face of the panel 435 and terminates in an upturned attachment section 461, as in previous embodiments. As in the embodiment depicted in FIG. 6, strengthening member 450 may include a second extension 470 having a pinch resisting extension 490 and hinge leaf trapping flange 478.

An upwardly extending tab, generally indicated by the numeral 496, may be formed at the inboard end 497 of first extension 460 to serve to impart rigidity to the strengthening member 450. As shown, tab 496 may be L-shaped and include a first leg 498 extending upward from extension 460 and a second leg 499 extending rearwardly of the door.

In general, installation of the previously described strengthening members may be performed in a similar manner and, thus, the following description will refer to the strengthening member 50 and its related components. Specific differences in the method of installation between embodiments will be noted by reference to the specific components and their reference numeral. In general, strengthening member 50 is installed by orienting the strengthening member 50 such that the first and second extension 60, 70 are easily inserted between the backer member 38 and hinge 40. In the embodiments depicted in FIGS. 3, 4 and 5, the body portion 51 is generally oriented vertically, in the orientation of the door D depicted, to allow insertion of the first and second extensions 60, 70. These extensions 60, 70 are driven forwardly toward the face of the door D between the backing member 38 and hinge 40. It will be appreciated that some deformation of the backing member 38 and hinge 40 may be necessary to achieve insertion of the extensions 60, 70. As previously mentioned, radius surfaces on the strengthening member 50 may facilitate the insertion of extension 60, 70. With respect to the embodiments depicted in FIGS. 6 and 7, the body portion 351, 451 is similarly oriented in a upwardly extending vertical position, such that, the body portion 351, 451 is adjacent the superjacent panel 335A, 435A. In these embodiments, the ends of attachment portions 361, 461 are inserted between the backing member 338, 438 and hinges 340, 440. From the insertion position, strengthening members 350, 450 are rotated to complete the insertion of first and second extensions 360, 370 and 460, 470. As the strengthening members 350, 450 are rotated, the second extensions 370, 470 capture the ends of the hinge leaves 341, 342 and 441, 442. At this point, the strengthening members 350, 450 are essentially integrally interconnected with the panels 335, 435. If necessary, an adhesive 356, 456 may be applied to further secure the strengthening members 350, 450, as described previously.

Thus, it should be evident that the sectional door strengthening members disclosed herein carry out one or more of the objects of the present invention set forth above and otherwise constitutes an advantageous contribution to the art. As will be apparent to persons skilled in the art, modifications can be made to the preferred embodiments disclosed herein without departing from the spirit of the invention, the scope of the invention herein being limited solely by the scope of the attached claims.

What is claimed is:

1. A reinforced sectional door comprising, a plurality of panels, a plurality of hinge leaves connecting adjacent panels at the edges thereof, a strengthening member adapted for direct fixed attachment to one of said panels and extending rearwardly relative to said panels and said hinge leaves, said strengthening member further being adapted to capture said hinge leaves of said adjacent panels, whereby said strengthening member becomes substantially integral with the door upon assembly.

2. The reinforced sectional door of claim 1, wherein said strengthening member has a body portion that includes a first extension attachable to one of said panels.

3. The reinforced sectional door of claim 2, wherein said first extension is insertable between walls of said one of said panels.

4. The reinforced sectional door of claim 3, wherein said first extension is fastened to one of said panels with a non-mechanical fastener.

5. The reinforced sectional door of claim 4, wherein said non-mechanical fastener is an adhesive.

6. The reinforced sectional door of claim 2, wherein said first extension is fastened to an interior surface of one of said panels.

7. The reinforced sectional door of claim 2 further comprising, a second extension adapted to capture said edges.

8. The reinforced sectional door of claim 7, wherein said second extension extends in an arcuate manner around said hinge leaves.

9. A reinforced sectional door comprising, a plurality of panels, a plurality of hinge leaves connecting adjacent panels at the edges thereof, a strengthening member having a body portion adapted for direct fixed attachment to the door and extending rearwardly relative thereto, said body portion being adapted to capture said hinge leaves of adjacent panels, said strengthening member including a first extension attachable to an interior surface of one of said panels, said first extension including an attachment portion that extends parallel to said interior surface, and a fastener attaching said attachment portion to said interior surface, whereby said body portion becomes substantially integral with the door upon assembly.

10. The reinforced sectional door of claim 9, wherein said fastener is an adhesive.

11. A door comprising, a plurality of panels, a first hinge leaf formed on one edge of a panel and a second hinge leaf formed on a second edge of said panel, wherein first and second hinge leaves on adjacent panels interrelate to form a hinge pivotally joining said panels, and a strengthening member adapted to capture said hinge leaves and directly and fixedly attachable to one of said adjacent panels near at least one of said first hinge leaf and said second hinge leaf.

12. The door of claim 11, wherein said strengthening member has a body portion that extends rearwardly of said panels and said hinge leaves a selected length.

13. The door of claim 11, wherein said strengthening member includes a first extension having an upturned end adapted to attach said strengthening member to one of said panels.

14. The door of claim 13, wherein said strengthening member includes a second extension extending around a portion of said first and second hinge leaves.

15. A strengthening member used to be directly and fixedly reinforce a door having a plurality of panels pivotally joined to each other by a hinge, the hinge having a first hinge leaf and a second hinge leaf extending from the edges of the joined panels, the strengthening member comprising, a body portion extending a length rearward of said panels and said hinge, said body portion including a first extension adapted to attach to one of said plurality of panels and a second extension adapted to capture the hinge leaves, whereby the door is reinforced at the hinges between the panels of the door.

16. The strengthening member of claim 15, wherein said second extension substantially conforms to the hinge leaves.

17. The strengthening member of claim 16, wherein said second extension extends downward and inward in an arcuate configuration.

18. The strengthening member of claim 16, further comprising a gap extension extending upward and inward from a lower extremity of said second extension, whereby said gap extension prevents the opening of gaps between the panel and said body portion during operation of the door.

19. The strengthening member of claim 18, wherein a flange extends from an end of said gap extension.

20. The strengthening member of claim 18, wherein said flange extends from the lower extremity of said second extension.

21. The strengthening member of claim 15, further comprising a tab extending outward from said body portion adjacent a rear surface of the panel.

22. The strengthening member of claim 21, wherein said tab is made generally L-shaped having a first leg extending upward from said body portion and a second leg extending rearward of said first leg.

23. The strengthening member of claim 21, wherein said tab is located on said first extension of said body portion.

24. A strengthening member used to reinforce a door having a plurality of panels pivotally joined to each other by a hinge, the hinge having a first hinge leaf and a second hinge leaf extending from the edges of the joined panels, the strengthening member comprising, a body portion extending a length rearward of the door, said body portion including a first extension adapted to attach to the door and a second extension adapted to capture the hinge leaves, said body portion including a first leg and a second leg extending rearward relative to the door and generally parallel to each other, said first and second legs being joined at their rearward extremity by a third leg, wherein said first extension extends from said first leg and second extension extends from said second leg, whereby the door is reinforced at the hinges between the panels of the door.

25. The strengthening member of claim 24, wherein said first and second legs lie in close proximity to each other.

26. The strengthening member of claim 24, wherein said third leg extends generally perpendicular to said first and second legs defining a hollow rectangular body portion.

27. The strengthening member of claim 15, wherein said first extension extends upwardly and inwardly from said body portion, said first extension having an attachment portion at its inward extremity, whereby said attachment portion is insertable between the hinge and the panel.

28. The strengthening member of claim 27, wherein said attachment portion extends upwardly parallel to the face of the panel when in operative position.

29. The strengthening member of claim 28, wherein said first extension extends upwardly and inwardly toward a rear face of the panel and downwardly and inwardly interiorly of the rear face.

30. The strengthening member of claim 29, wherein said first extension is substantially arcuate extending in a generally semicircular fashion.

31. The strengthening member of claim 28, wherein said first extension transcends an arcuate transition portion leading into said attachment portion, whereby said transition portion facilitates insertion of said first extension between the hinge and the panel.

* * * * *

UNITED STATES PATENT AND TRADEMARK OFFICE

CERTIFICATE OF CORRECTION

PATENT NO. : 6,899,157 B2
DATED : May 31, 2005
INVENTOR(S) : Willis J. Mullet

It is certified that error appears in the above-identified patent and that said Letters Patent is hereby corrected as shown below:

Column 11,
Line 11, after "to" (first occurrence), insert -- directly and fixedly --.

Signed and Sealed this

Fourteenth Day of February, 2006

JON W. DUDAS
*Director of the United States Patent and Trademark Office*